US010084247B2

(12) United States Patent
Matsui et al.

(10) Patent No.: US 10,084,247 B2
(45) Date of Patent: Sep. 25, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hajime Matsui, Mie (JP); Yasuo Omori, Mie (JP)

(73) Assignees: AUTONETWORKS TECHNOLOGIES, LTD. (JP); SUMITOMO WIRING SYSTEMS, LTD. (JP); SUMITOMO ELECTRIC INDUSTRIES, LTD. (JP)

( * ) Notice: Subject to any disclaimer, the term of this patent is extended or adjusted under 35 U.S.C. 154(b) by 0 days.

(21) Appl. No.: 15/548,182

(22) PCT Filed: Jan. 29, 2016

(86) PCT No.: PCT/JP2016/052606

§ 371 (c)(1),
(2) Date: Aug. 2, 2017

(87) PCT Pub. No.: WO2016/132856

PCT Pub. Date: Aug. 25, 2016

(65) Prior Publication Data

US 2018/0034168 A1 Feb. 1, 2018

(30) Foreign Application Priority Data

Feb. 18, 2015 (JP) ..... 2015-029439

(51) Int. Cl.

| | |
|---|---|
| ***H01R 4/24*** | (2018.01) |
| ***H01R 4/245*** | (2018.01) |
| ***H01R 4/70*** | (2006.01) |

(52) U.S. Cl.
CPC ..... *H01R 4/245* (2013.01); *H01R 4/70* (2013.01)

(58) Field of Classification Search
CPC .... H01R 4/2466; H01R 4/245; H01R 4/2433; H01R 4/2429; H01R 4/2412; H01R 9/0757; H01R 13/506
(Continued)

(56) References Cited

U.S. PATENT DOCUMENTS 4,693,537 A * 9/1987 Dinsmore ..... H01R 13/506 439/399
6,045,389 A * 4/2000 Ferrill ..... H01R 9/031 439/398

(Continued)

FOREIGN PATENT DOCUMENTS

| | | |
|---|---|---|
| JP | 8-162183 | 6/1996 |
| JP | 2001-185249 | 7/2001 |
| JP | 2010-3461 | 1/2010 |

OTHER PUBLICATIONS

International Search Report dated Apr. 26, 2016.

*Primary Examiner* — Hien Vu
(74) *Attorney, Agent, or Firm* — Gerald E. Hespos; Michael J. Porco; Matthew T. Hespos

(57) ABSTRACT

It is aimed to reduce work man-hours when a twisted pair cable is brought into pressure contact. A connector (C) includes two insulation displacement terminal fittings (30) with which wires (41A, 41B) constituting a twisted pair cable (40A, 40B) are individually brought into pressure contact, a holder (10) configured to hold the two insulation displacement terminal fittings (30) such that pressure contact portions (34) formed in the insulation displacement terminal fittings (30) are arranged in a direction intersecting with a routing direction of the twisted pair cable (40A, 40B), and a dividing rib (37, 38) formed in the holder (10) and
(Continued)

configured to separate two wires (41A, 41B) to correspond to two pressure contact portions (34) in the process of bringing the twisted pair cable (40A, 40B) closer to pressure contact positions with the pressure contact portions (34).

13 Claims, 9 Drawing Sheets

(58) Field of Classification Search
USPC ..... 439/397–417
See application file for complete search history.

(56) References Cited

U.S. PATENT DOCUMENTS 6,050,842 A * 4/2000 Ferrill ..... H01R 4/2429
439/404
6,488,525 B2 * 12/2002 Abel ..... H01R 13/6477
439/404
7,862,388 B2 * 1/2011 Dennes ..... H01R 9/2416
439/404
9,033,725 B2 * 5/2015 Fransen ..... H01R 13/6461
439/344

* cited by examiner

CONNECTOR

BACKGROUND

1. Field of the Invention

The present invention relates to a connector.

2. Description of the Related Art

Japanese Unexamined Patent Publication No. H08-162183 discloses a connector in which two insulation displacement terminals are arranged laterally in a housing and two wires constituting twisted pair cables are connected respectively to the separate insulation displacement terminals. This connector is used as a joint connector for branching two twisted pair cables.

A twisted pair cable is formed by bringing two wires closer and spirally twisting them. However, end regions of the two wires of the twisted pair cable must be untwisted and separated to cause the two wires to correspond respectively to the two insulation displacement terminals.

The invention was completed based on the above situation and aims to reduce work man-hours when a twisted pair cable is brought into pressure contact.

SUMMARY

The invention is directed to a connector with two insulation displacement terminal fittings with which wires constituting a twisted pair cable are individually brought into pressure contact. The connector has a holder configured to hold the two insulation displacement terminal fittings so that pressure contact portions formed in the insulation displacement terminal fittings are arranged in a direction intersecting a routing direction of the twisted pair cable. A dividing rib is formed in the holder and is configured to separate two wires to correspond to two pressure contact portions in the process of bringing the twisted pair cable closer to pressure contact positions with the pressure contact portions.

When the twisted pair cable is brought closer to the pressure contact positions with the pressure contact portions, the dividing rib separates the two wires to correspond to the pressure contact portions. It is not necessary to separate the two wires before a pressure contact step according to the present invention, and therefore work man-hours are reduced.

The dividing rib may be formed with a guide having a wedge-shaped cross-section narrowed toward a tip side in a projecting direction thereof. According to this configuration, the two wires can be separated reliably by thrusting the guide into between the two wires.

The pressure contact portion may include two pairs of pressure contact blades spaced apart in the routing direction of the twisted pair cable, and a formation area of the dividing rib in the routing direction of the twisted pair cable may be a range equal to or wider than a range including the two pairs of pressure contact blades. According to this configuration, the wires can be brought positively or as you are reliably into pressure contact with the two pairs of pressure contact blades.

The pressure contact portion may include two supporting plates rising from both side edges of a base plate and arranged to face each other and pressure contact blades paired and projecting from facing surfaces of the two supporting plates. The dividing rib may rise substantially in the same direction as a rising direction of the supporting plates, and the dividing rib may rise to a position higher than rising end edges of the supporting plates in the rising direction of the supporting plates. According to this configuration, the two wires can be separated reliably before being inserted between the pairs of the supporting plates The pressure contact portion may include pressure contact blades paired to sandwich the wire. The pressure contact blades may be formed with guide edges configured to guide the wire between the paired pressure contact blades by being held in sliding contact with the wire. Sliding contact surfaces of the dividing rib with the wires and the guide edges may be arranged at an obtuse angle to each other. According to this configuration, the two wires separated by the dividing rib can smoothly enter between the pressure contact blades.

DETAILED DESCRIPTION

One specific embodiment of the invention is described with reference to FIGS. 1 to 9. A connector C of this embodiment is designed to bring a first twisted pair cable 40A and a second twisted pair cable 40B into pressure contact. The first twisted pair cable 40A is formed by bringing two first wires 41A closer and spirally twisting them. Similarly, the second twisted pair cable 40B is formed by bringing two second wires 41B closer and spirally twisting them. The connector C has a function as a joint connector C of an insulation displacement type for connecting the first twisted pair cable 40A and the second twisted pair cable 40B, and realizes a reduction of work man-hours when both twisted pair cables 40A, 40B are brought into pressure contact.

Note that, in the following description, a routing direction of the twisted pair cables 40A, 40B in a pressure contact area with insulation displacement terminal fittings 30 is defined as a front-rear direction. Further, it is assumed that the first twisted pair cable 40A is mounted into and connected to the connector C from above and the second twisted pair cable 40B is mounted into and connected to the connector C from below.

Figure 4:
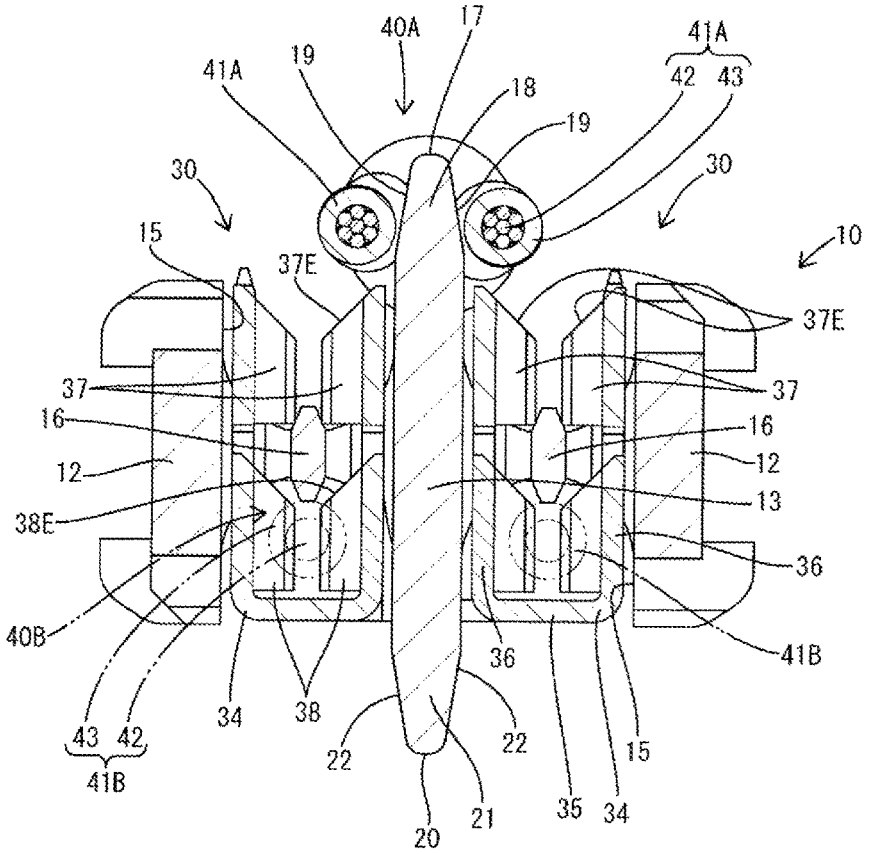
FIG. 4 is an enlarged section showing the state where the wires are divided by the dividing rib.

The connector C conductively connects one first wire 41A of the first twisted pair cable 40A and one second wire 41B of the second twisted pair cable 40B and conductively connects the other first wire 41A of the first twisted pair cable 40A and the other second wire 41B of the second twisted pair cable 40B. As shown in FIG. 4, each wire 41A, 41B has a known form with a conductor 42 surrounded by an insulation coating 43.

Figure 2:
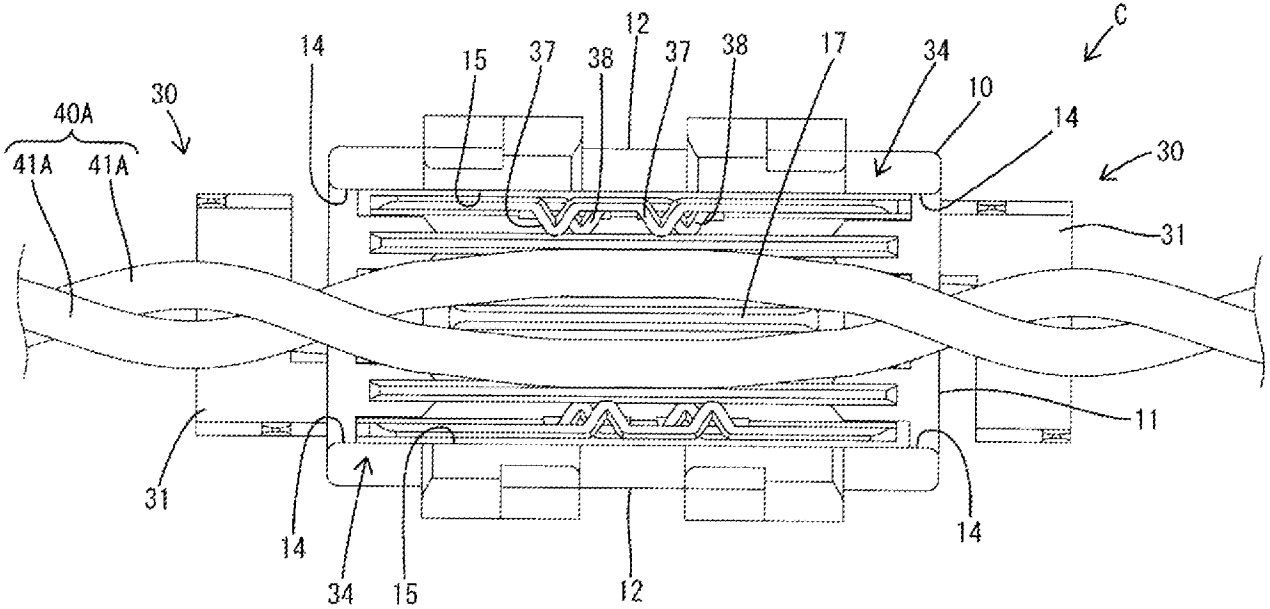
FIG. 2 is a plan view showing the state where the wires are divided by the dividing rib.
Figure 3:
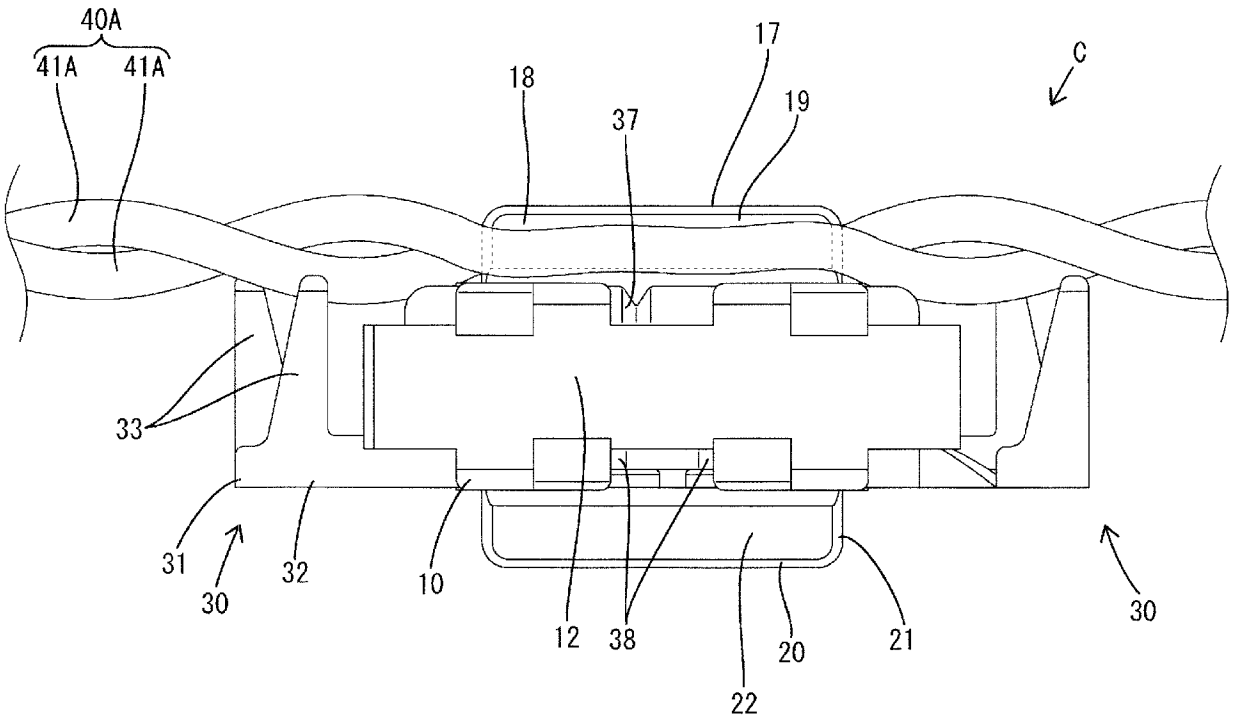
FIG. 3 is a side view showing the state where the wires are divided by the dividing rib.
Figure 5:
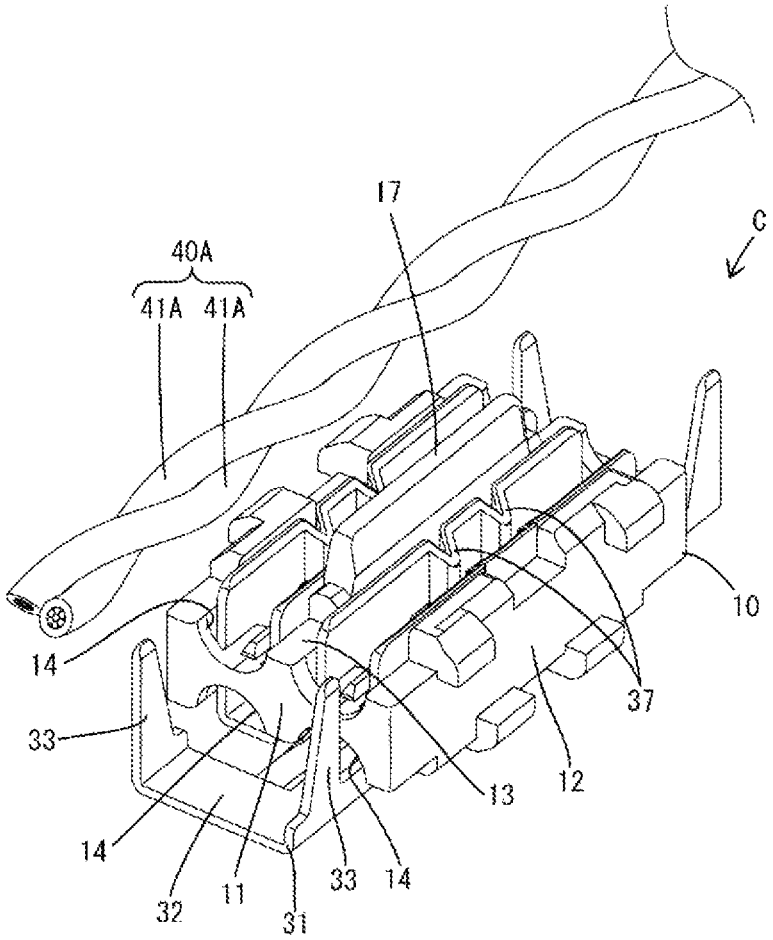
FIG. 5 is a perspective view showing a state before the wires are divided.
Figure 6:
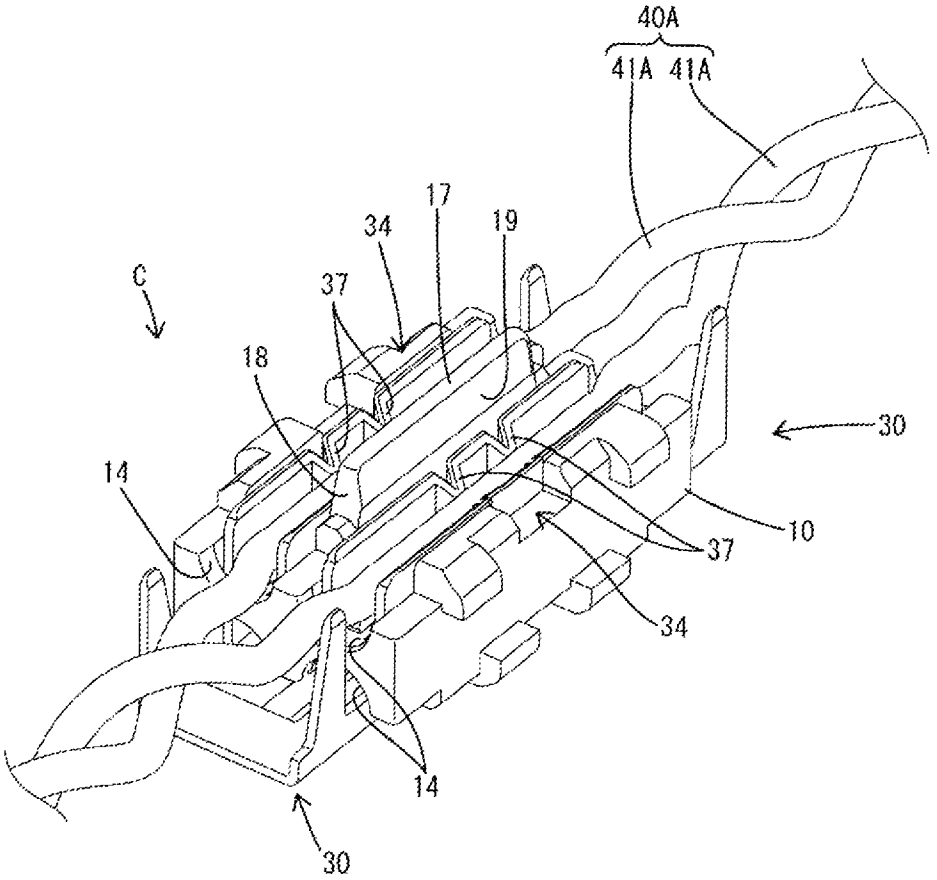
FIG. 6 is a perspective view showing a state where the wires are brought into pressure contact with pressure contact portions.

As shown in FIGS. 4 and 7 to 9, the connector C includes a holder 10 and two insulation displacement terminal fittings 30. The holder 10 is made of synthetic resin and defines a single component including two of end walls 11 arranged to face each other while being spaced apart in the front-rear direction, left and right side walls 12 coupling the left and right end edges of the pair of end walls 11 and one separation wall 13 coupling laterally central parts of the end walls 11. The side walls 12 and the separation wall 13 extend long in the front-rear direction. As shown in FIGS. 2 and 5, left and right recesses 14 are formed on each of the upper and lower end edges of the end wall 11 and have substantially semi-circular shapes. The recesses 14 are for positioning the wires in a lateral direction and restrict upward and downward displacements of the wires.

Figure 7:
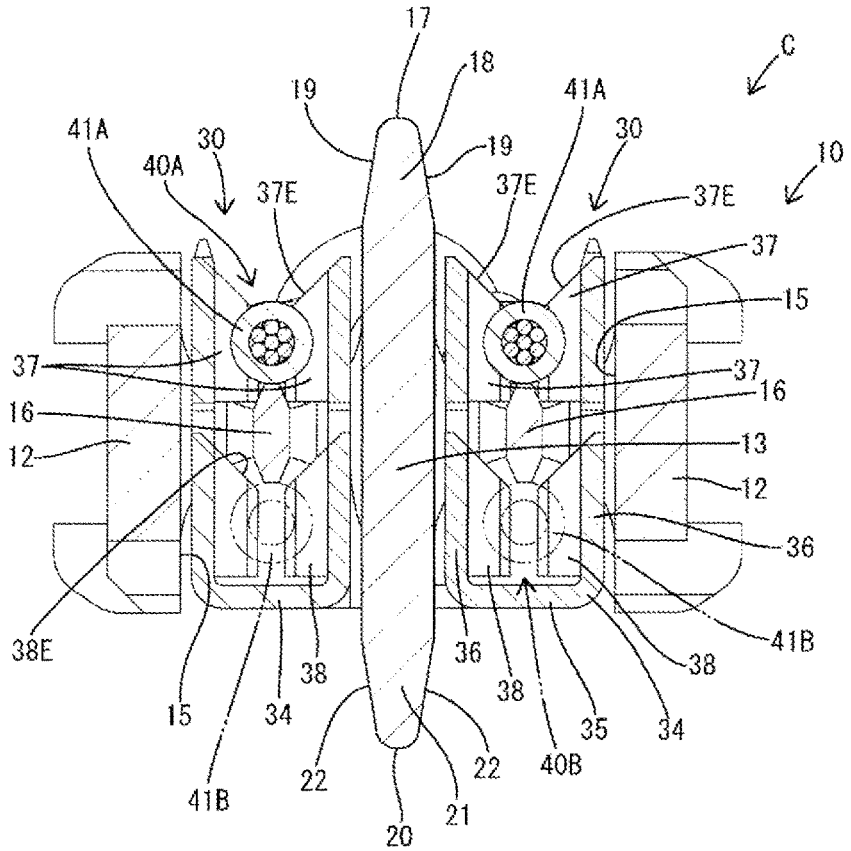
FIG. 7 is an enlarged section showing the state where the wires are brought into pressure contact with the pressure contact portions.

As shown in FIGS. 4 and 7 to 9, left and right spaces enclosed by the respective walls 11, 12 and 13 of the above-described holder 10 form left and right mounting spaces 15 that are long in the front-rear direction and have open upper and lower surfaces. A pressure contact portion 34, to be described later, is accommodated into each mounting space 15. Further, as shown in FIGS. 4 and 7, a beam 16 is arranged in each mounting space 15 and extends between the front and rear end walls 11. The beam 16 restricts a downward displacement of the wire brought into pressure contact with upper pressure contact blades 37, to be described later, and restricts an upward displacement of the wire brought into pressure contact with lower pressure contact blades 38.

As described above, the separation wall 13 is located between the two pressure contact portions 34 accommodated in the two mounting spaces 15. This separation wall 13 is formed integrally with an upper dividing rib 17 projecting up from the upper end edge thereof and a lower dividing rib 20 projecting down from the lower end edge thereof. The upper and lower dividing ribs 17, 20 are bilaterally symmetrical. A formation area of the upper and lower dividing ribs 17, 20 in the front-rear direction is a range including a formation area of four pairs of pressure contact blades 37, 38, to be described later, and areas in front of and behind the four pairs of pressure contact blades 37, 38.

As shown in FIGS. 4 and 7, the upper dividing rib 17 is formed with an upper guide 18 having a wedge-shaped cross-section narrowed toward an upper side (tip side of the upper dividing rib 17 in a projecting direction). The upper guide 18 is formed in the entire area of the upper dividing rib 17 in the vertical projecting direction. Both left and right side surfaces of this upper guide 18 serve as upper slide-contact surfaces 19.

Similarly, the lower dividing rib 20 also is formed with a lower guide 21 having a wedge-shaped cross-section narrowed toward a lower side (tip side of the lower dividing rib 20 in a projecting direction). The lower guide 21 also is formed in the entire area of the lower dividing rib 20 in the vertical projecting direction. Both left and right side surfaces of this lower guide 21 serve as lower slide-contact surfaces 22.

Figure 1:
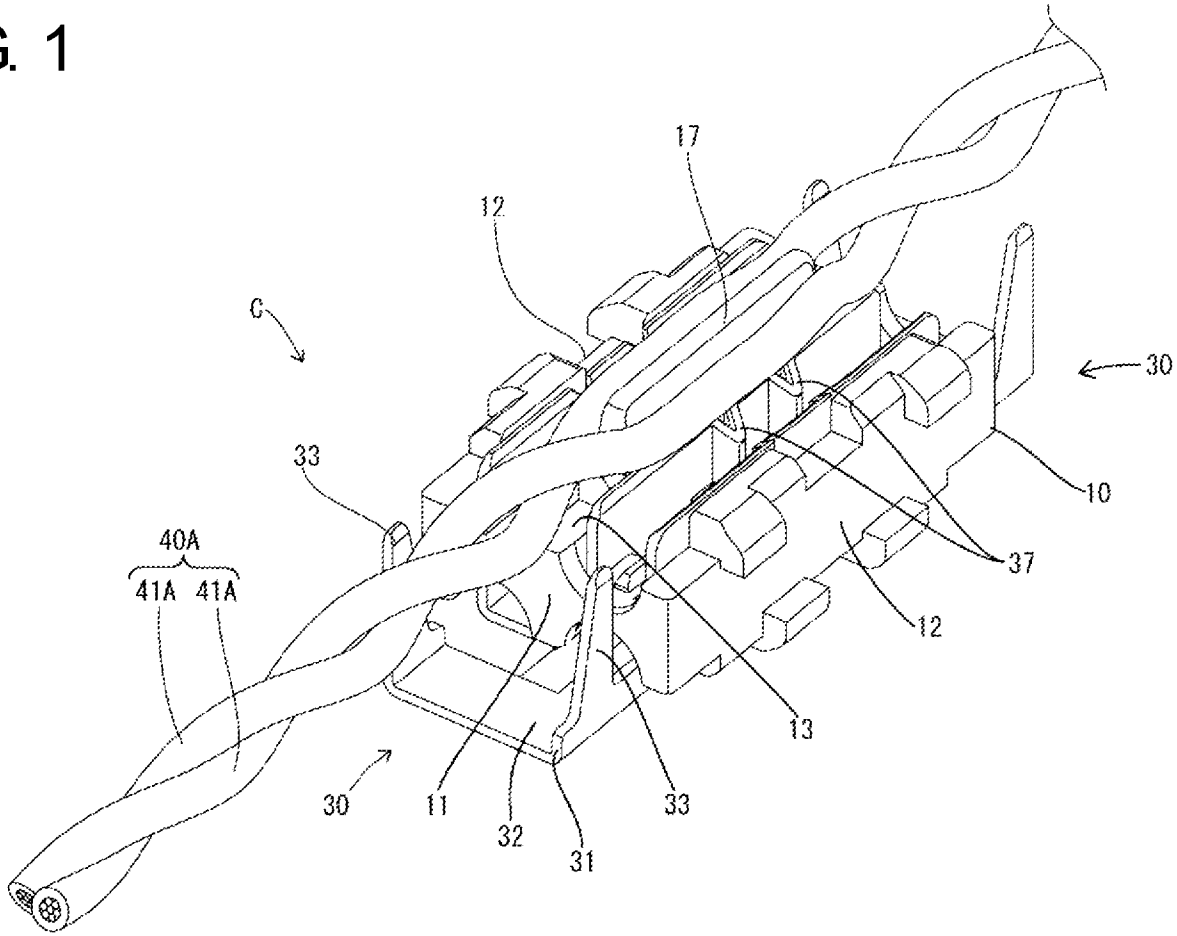
FIG. 1 is a perspective view showing a state where wires are divided by a dividing rib in one embodiment.
Figure 8:
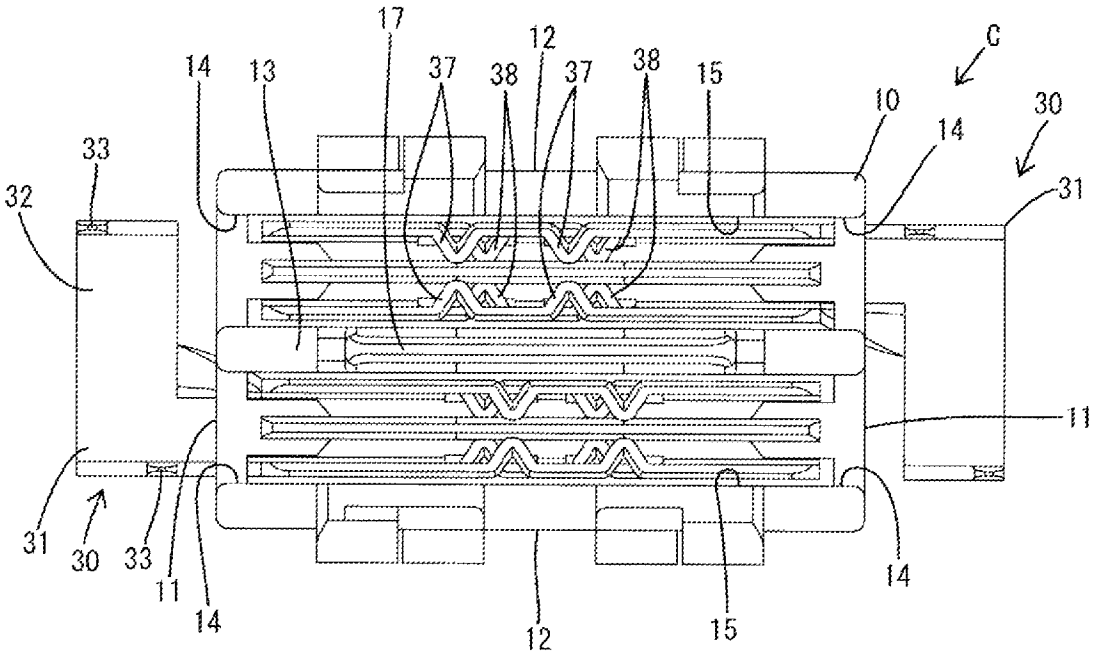
FIG. 8 is a plan view of a connector.
Figure 9:
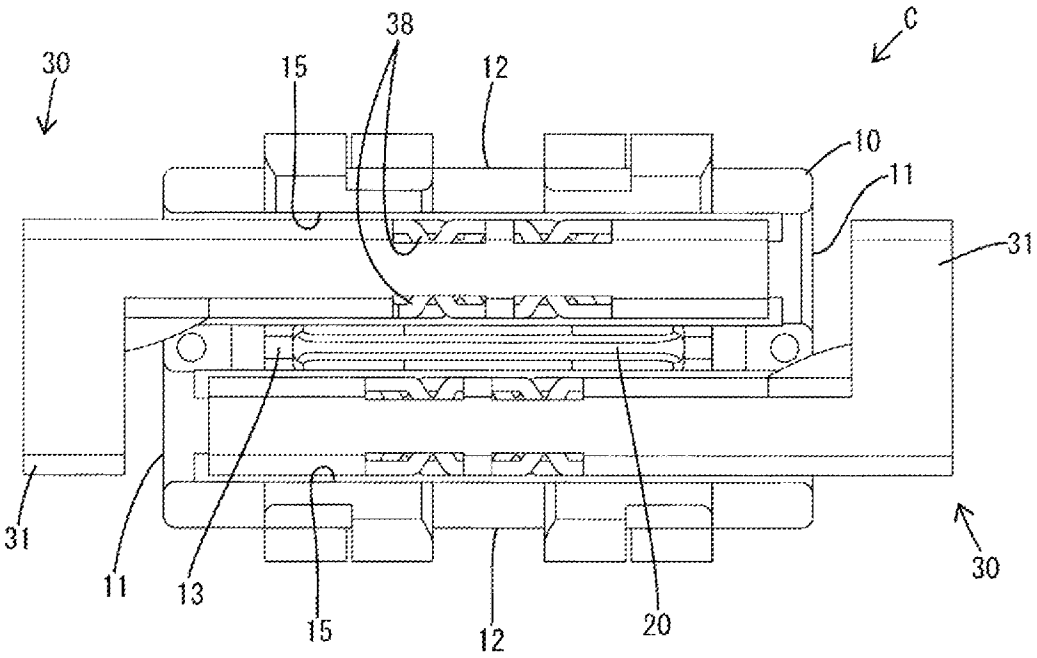
FIG. 9 is a bottom view of the connector.

The insulation displacement terminal fittings 30 are shaped and sized identically and, as shown in FIGS. 8 and 9, are arranged point-symmetrically in a plan view. The insulation displacement terminal fitting 30 is a single component including a wire holding portion 31 and a long and narrow pressure contact portion 34 extending forward from the wire holding portion 31. As shown in FIG. 1, the wire holding portion 31 is composed of a horizontal receiving plate 32 that is substantially rectangular in a plan view and two crimping pieces 33 rising from both left and right side edges of the receiving plate 32.

As shown in FIGS. 4 and 7, the pressure contact portion 34 includes a long and narrow base plate 35 extending horizontally forward from a right end part of the front edge of the receiving plate 32, two supporting plates 36 cantilevered up substantially at a right angle from both left and right side edges of the base plate 35 and four pairs of pressure contact blades 37, 38. As shown in FIGS. 1 and 8, the paired pressure contact blades 37, 38 are projecting in while being substantially V-shaped in a plan view by bending parts of the left and right supporting plates 36. The upper end edge of the upper pressure contact blade 37 serves as an upper guide edge 37E and is inclined with respect to the vertical direction (pressure contact direction of the wire with the upper pressure contact blade 38). The upper end edge of the lower pressure contact blade 38 serves as a lower guide edge 38E inclined with respect to the vertical direction (pressure contact direction of the wire with the upper pressure contact blade 38).

Further, as shown in FIGS. 4 and 7, the four pairs of pressure contact blades 37, 38 are arranged separately in upper and lower stages. Two pairs of upper pressure contact blades 37 arranged in the upper stage are arranged at a predetermined interval in the front-rear direction. Two pairs of lower pressure contact blades 38 arranged in the lower stage are arranged at a predetermined interval in the front-rear direction. As shown in FIG. 8, the front upper pressure contact blades 37 and the front lower pressure contact blades 38 are displaced in the front-rear direction. The rear upper pressure contact blades 37 and the rear lower pressure contact blades 38 also are displaced in the front-rear direction.

The two insulation displacement terminal fittings 30 are mounted into the holder 10 from below, and the pressure contact portions 34 are accommodated respectively into the mounting spaces 15. With the pressure contact portions 34 accommodated in the mounting spaces 15, the upper dividing rib 17 is located above the upper edges of the supporting plates 36 and rises in the same direction as a rising direction of the supporting plates 36. Lower end parts of the upper slide-contact surfaces 19 are located at an obtuse angle to and vertically proximate to upper end parts of the upper guide edges 37E of the inner (side closer to the separation wall 13 and the upper dividing rib 17) upper pressure contact blades 37.

Next, functions of this embodiment are described. The holder 10 and the insulation displacement terminal fittings 30 are assembled in parallel with a step of crimping the insulation displacement terminal fittings 30 and the wires 41A, 41B. In assembling, the two second wires 41B of the second twisted pair cable 40B are divided laterally by the lower dividing rib 20. At this time, the lower end edge of the lower dividing rib 20 is thrust into a clearance between the twisted two wires 41B. When the second twisted pair cable 40B is moved up, the two second wires 41B are separated gradually while sliding in contact with the lower slide-contact surfaces 22 by the gradually widened lower guide 21 of the lower dividing rib 20. The two second wires 41B having passed through the lower dividing rib 20 are accommodated respectively into the mounting spaces 15.

Thereafter, two pressure contact portions 34 are accommodated respectively into the mounting spaces 15 from below the holder 10. In an accommodating process, the two second wires 41B come into contact with the upper guide edges 37E of the upper pressure contact blades 37 to be pushed up. However, since the second wires 41B are in contact with the beam 16 and upward displacements thereof are restricted, two pairs of upper pressure contact blades 37 pass through the second wires 41B. When the pressure contact portions 34 are pushed farther into the mounting spaces 15, two pairs of front and rear lower pressure contact blades 38 are brought into pressure contact with the second wires 41B to sandwich the second wires 41B laterally. The paired lower pressure contact blades 38 cut the insulation coatings 43 open and come into contact with the conductors 42 to sandwich the conductors 42 from both left and right sides.

In this way, the two second wires 41B of the second twisted pair cable 40B are brought separately brought into pressure contact with the two insulation displacement terminal fittings 30 and the two insulation displacement terminal fittings 30 are assembled with the holder 10. In this state, the wire holding portions 31 are located to correspond to the end walls 11 outside the mounting space 15.

Thereafter, the two first wires 41A of the first twisted pair cable 40A are brought into pressure contact with the two pressure contact portions 34 while being divided laterally. At this time, the upper end edge of the upper dividing rib 17 is thrust into a clearance between the twisted two wires 41A. When the first twisted pair cable 40A is moved down, the two first wires 41A are separated gradually while sliding in contact with the upper slide-contact surfaces 19 by the gradually widened upper dividing rib 17 of the upper guide 18, as shown in FIG. 4. The two first wires 41A having passed through the upper dividing rib 17 are accommodated respectively into the mounting spaces 15.

When being accommodated into the mounting spaces 15, the first wires 41A transfer from the lower end parts of the upper slide-contact surfaces 19 to the upper guide edges 37E of the upper pressure contact blades 37. Here, since the upper slide-contact surfaces 19 and the upper guide edges 37E are arranged at an obtuse angle to and proximate to each other, the first wires 41A smoothly transfer from the upper slide-contact surfaces 19 to the upper guide edges 37E without being caught or the like. One first wire 41A is brought into pressure contact with the pressure contact portion 34 of one insulation displacement terminal fitting 30, and the other first wire 41A is brought into pressure contact with the pressure contact portion 34 of the other insulation displacement terminal fitting 30. When being brought into pressure contact, the first wire 41A is pushed between the two front and rear pairs of upper pressure contact blades 37. The paired upper pressure contact blades 37 cut the insulation coatings 43 open and come into contact with the conductors 42 to sandwich the conductors 42 from both left and right sides. In this way, the two pressure contact portions 34 (insulation displacement terminal fittings 30) and the two first wires 41A individually are connected conductively.

When the four wires 41A, 41B are brought into pressure contact, one first wire 41A of the first twisted pair cable 40A and one second wire 41B of the second twisted pair cable 40B are connected conductively to one insulation displacement terminal fitting 30 (pressure contact portion 34). Further, the other first wire 41A of the first twisted pair cable 40A and the other second wire 41B constituting the second twisted pair cable 40B are connected conductively to the other insulation displacement terminal fitting 30 (pressure contact portion 34). After all of the four wires 41A, 41B are brought into pressure contact with the insulation displacement terminal fittings 30, the four wires 41A, 41B are held collectively in each wire holding portion 31. Specifically, the four wires 41A, 41B (first and second twisted pair cables 40A, 40B) placed on the receiving plate 32 are surrounded by the of left and right crimping pieces 33. In this way, the four wires 41A, 41B are held in pressure contact with the pressure contact portions 34 and the holder 10 and the two insulation displacement terminal fittings 30 are fixed.

The connector C of this embodiment includes, for the purpose of reducing work man-hours, the two insulation displacement terminal fittings 30 with which the two first wires 41A constituting the first twisted pair cable 40A are individually brought into pressure contact and the two second wires 41B constituting the second twisted pair cable 40B are individually brought into pressure contact. In the holder 10 holding the two insulation displacement terminal fittings 30, the pressure contact portions 34 formed in the insulation displacement terminal fittings 30 are arranged in a direction intersecting with the routing direction of the twisted pair cables 40A, 40B.

The holder 10 is provided with the upper dividing rib 17 for separating the two first wires 41A to correspond to the two pressure contact portions 34 in the process of bringing the first twisted pair cable 40A closer to pressure contact positions with the pressure contact portions 34. Thus, when the first twisted pair cable 40A is brought closer to the pressure contact positions with the pressure contact portions 34, the two first wires 41A are separated to correspond to the pressure contact portions 34 by the upper dividing rib 17. As just described, work man-hours are reduced since it is not necessary to separate the two first wires 41A in advance before a pressure contact step.

Similarly, the holder 10 is provided with the lower dividing rib 20 for separating the two second wires 41B to correspond to the two pressure contact portions 34 in the process of bringing the second twisted pair cable 40B closer to pressure contact positions with the pressure contact portions 34. Thus, when the second twisted pair cable 40B is brought closer to the pressure contact positions with the pressure contact portions 34, the two second wires 41B are separated to correspond to the pressure contact portions 34 by the lower dividing rib 20. As just described, work man-hours are reduced since it is not necessary to separate the two second wires 41B in advance before the pressure contact step.

The upper dividing rib 17 is formed with the upper guide 18 having a wedge-shaped cross-section narrowed in width in an arrangement direction of the pressure contact portions 34 toward the tip (upper end). Thus, the two first wires 41A can be separated reliably by thrusting the upper guide 18 between the two first wires 41A. Similarly, since the lower dividing rib 20 is formed with the lower guide 21 having a wedge-shaped cross-section narrowed in width in the arrangement direction of the pressure contact portions 34 toward the tip (lower end), the two second wires 41B can be separated reliably by thrusting the lower guide 18 between the two second wires 41B.

Further, the pressure contact portion 34 includes two pairs of upper pressure contact blades 37 spaced apart in the front-rear direction (routing direction of the twisted pair cables 40A, 40B). The formation area of the upper dividing rib 17 in the front-rear direction is a range wider than a range including the two pairs of upper pressure contact blades 37. According to this configuration, the two first wires 41A are separated over the range including a formation area of the two pairs of upper pressure contact blades 37 when being laterally divided by the upper dividing rib 17. Thus, following the step of dividing the first wires 41A by the upper dividing rib 17, the first wires 41A can be brought reliably into pressure contact with the upper pressure contact blades 37.

Further, the pressure contact portion 34 includes the supporting plates 36 rising from the side edges of the base plate 35 and arranged to face each other and the paired upper pressure contact blades 37 projecting form the facing surfaces of the pair of supporting plate portions 36. On the other hand, the upper dividing rib 17 rises substantially in the same direction as the rising direction of the supporting plates 36. In the rising direction of the supporting plates 36, the upper dividing rib 17 rises to a position higher than the rising end edges of the supporting plates 36. According to this configuration, the two first wires 41A can be separated reliably before being inserted between the corresponding pair of supporting plates 36.

Further, the pressure contact portion 34 includes the upper pressure contact blades 37 paired to sandwich the first wire 41A, and the upper pressure contact blades 37 are formed with the upper guide edges 37E for guiding the first wire 41A between the paired upper pressure contact blades 37 by being held in sliding contact with the first wire 41A. The upper slide-contact surfaces 19 of the upper dividing rib 17, with which the first wires 41A slide in contact, and the upper guide edges 37E are arranged at an obtuse angle to each other. According to this configuration, the two first wires 41A separated by the upper dividing rib 17 can smoothly enter between the upper pressure contact blades 37.

The invention is not limited to the above described embodiment. For example, the following various embodiments also are included in the scope of the invention.

Although the dividing rib is formed with the guide having a wedge-shaped cross-section in the above embodiment, the dividing rib may not include the guide having a wedge-shaped cross-section.

Although the formation area of the dividing rib in the routing direction of the twisted pair cables is the range wider than the range including the two pairs of upper pressure contact blades, the formation area of the dividing rib may be a range equal to or narrower than the range including the two pairs of upper pressure contact blades.

Although the slide-contact surfaces of the upper dividing rib and the guide edges of the pressure contact blades are arranged at an obtuse angle to each other in the above embodiment, the slide-contact surfaces of the upper dividing rib and the guide edge portions of the pressure contact blades may be arranged substantially at a right angle to each other.

Although the slide-contact surfaces of the upper dividing rib and the guide edge portions of the pressure contact blades are arranged in proximity to each other in the above embodiment, the slide-contact surfaces and the guide edges may be arranged at separated positions.

Although one holder is formed with two upper and lower dividing ribs in the above embodiment, only one or three or more dividing ribs may be formed in one holder.

Although one insulation displacement terminal fitting is formed with one pressure contact portion in the above embodiment, one insulation displacement terminal fitting may be formed with a plurality of pressure contact portions.

Although one pressure contact portion is formed with four pairs of pressure contact blades in the above embodiment, the number of pairs of pressure contact blades formed in one pressure contact portion may be three or less or five or more.

Although the pressure contact blades are formed at two positions different in the rising direction of the supporting plates in the above embodiment, the pressure contact blades may be arranged at three or more positions in the rising direction of the supporting plates or may be arranged at one position in the rising direction of the supporting plates.

Although two insulation displacement terminal fittings are mounted in one holder in the above embodiment, the number of the insulation displacement terminal fittings to be mounted into one holder may be one or three or more.

LIST OF REFERENCE SIGNS

C . . . connector
10 . . . holder
17 . . . upper dividing rib
18 . . . upper guide
19 . . . upper slide-contact surface
20 . . . lower dividing rib
21 . . . lower guide
30 . . . insulation displacement terminal fitting
34 . . . pressure contact portion
35 . . . base plate
36 . . . supporting plate
37 . . . upper pressure contact blade
37E . . . upper guide edge
38 . . . lower pressure contact blade
40A . . . first twisted pair cable
40B . . . second twisted pair cable
41A . . . first wire
41B . . . second wire

The invention claimed is:

1. An electrical connector in which a plurality of twisted pair cables are brought into pressure contact, each of the twisted pair cables having first and second wires, the connector comprising:

first and second insulation displacement terminal fittings formed respectively with pressure contact portions with which the first and second wires constituting the respective twisted pair cables are individually brought into pressure contact;

a holder having alignment front and rear ends, the holder being configured to hold the first and second insulation displacement terminal fittings such that the pressure contact portions formed in the insulation displacement terminal fittings are arranged to contact the respective first and second wires inserted in a direction intersecting with a routing direction of the twisted pair cables;

a dividing rib formed in the holder and configured to separate the first and second wires of the respective twisted pair cable, the dividing rib rising to a position higher than the first and second pressure contact portions to guide the first and second wires to the respective first and second pressure contact portions while bringing the respective twisted pair cables closer to pressure contact positions with the first and second pressure contact portions; and first and second wire holding portions formed integrally with the respective first and second insulation displacement terminal fittings at positions external of the holder and at the alignment front and rear ends, the first and second wire holding portions being configured to collectively hold all of the wires constituting the twisted pair cables.

2. The electrical connector of claim 1, wherein the dividing rib is formed with a guide portion having a wedge-shaped cross-section narrowed toward a tip side in a projecting direction thereof.

3. The electrical connector of claim 2, wherein:

each of the pressure contact portions includes two pairs of pressure contact blades spaced apart in the routing direction of the twisted pair cables; and a formation area of the dividing rib in the routing direction of the twisted pair cables is a range equal to or wider than a range including the two pairs of pressure contact blades.

4. The electrical connector of claim 3, wherein:

the pressure contact portion includes two supporting plates rising from both side edges of a base plate and arranged to face each other, the pairs of pressure contact blades projecting from facing surfaces of the supporting plates;

the dividing rib rises substantially in the same direction as a rising direction of the supporting plates; and the dividing rib rises to a position higher than rising end edges of the holder in the rising direction of the supporting plates.

5. The electrical connector of claim 4, wherein:

each of the pressure contact portions includes pressure contact blades paired to sandwich the wire;

the pressure contact blades are formed with guide edges configured to guide the wire between the paired pressure contact blades by being held in sliding contact with the wire; and sliding contact surfaces of the dividing rib with the wires and the guide edges are arranged at an obtuse angle to each other.

6. The electrical connector of claim 1, wherein:

each of the pressure contact portion includes two pairs of pressure contact blades spaced apart in the routing direction of the twisted pair cables; and a formation area of the dividing rib in the routing direction of the twisted pair cables is a range equal to or wider than a range including the two pairs of pressure contact blades.

7. The electrical connector of claim 1, wherein the holder has first and second mounting spaces, each of which is open in upper and lower surfaces of the holder, first and second beams disposed respectively in the first and second mounting spaces, the first insulation displacement terminal being inserted through the open lower surface of the holder and into the first mounting space, the second insulation displacement terminal being inserted through the open lower surface of the holder and into the second mounting space.

8. The electrical connector of claim 7, wherein the pressure contact portions of the first insulation displacement terminal fitting extends from a location between the open lower surface of the holder and the first beam to a location between the open upper surface of the holder and the first beam, and wherein the pressure contact portions of the second insulation displacement terminal fitting extend from a location between the open lower surface of the holder and the second beam to a location between the open upper surface of the holder and the second beam.

9. The electrical connector of claim 7, wherein the dividing rib has a tapered wedge-shaped upper guide projecting out beyond the open upper surface of the holder and a tapered wage-shaped lower guide projecting out beyond the open lower surface of the holder.

10. An electrical connector in which a plurality of twisted pair cables are brought into pressure contact, comprising:

two insulation displacement terminal fittings formed respectively with pressure contact portions with which wires constituting the twisted pair cables are individually brought into pressure contact, each of the pressure contact portions includes two supporting plates rising from both side edges of a base plate and arranged to face each other and pressure contact blades paired and projecting from facing surfaces of the pair of supporting plates, wire holding portions having opposite front and rear ends, the wire holding portions being formed integrally with the insulation displacement terminal fittings and configured to collectively hold all of the wires constituting the twisted pair cables;

a holder having alignment front and rear ends and being configured to hold the two insulation displacement terminal fittings such that pressure contact portions formed in the insulation displacement terminal fittings are arranged in a direction intersecting with a routing direction of the twisted pair cables; and a dividing rib formed in the holder and configured to separate two of the wires to correspond to two pressure contact portions in the process of bringing the twisted pair cable closer to pressure contact positions with the pressure contact portions, wherein:

the dividing rib rises substantially in the same direction as a rising direction of the supporting plates; and the dividing rib rises to a position higher than rising end edges of the supporting plates in the rising direction of the supporting plates.

11. The electrical connector of claim 10, wherein:

the pressure contact portion includes pressure contact blades paired to sandwich the wire;

the pressure contact blades are formed with guide edges configured to guide the wire between the paired pressure contact blades by being held in sliding contact with the wire; and sliding contact surfaces of the dividing rib with the wires and the guide edges are arranged at an obtuse angle to each other.

12. An electrical connector for upper and lower twisted pair cables each of which has first and second wires, the connector comprising:

a holder having opposite longitudinal ends and upper and lower surfaces, first and second mounting spaces extending between the longitudinal ends and having openings in the upper and lower surfaces of the holder, a dividing rib extending longitudinally in the holder and separating the first and second mounting spaces, first and second beams disposed respectively in the first and second mounting spaces at positions spaced from the upper and lower surfaces; and first and second insulation displacement terminal fittings inserted respectively through the openings of the first and second mounting spaces in the lower surface of the holder, the first insulation displacement terminal fitting having lower pressure contact portions between the lower surface of the holder and the first beam for contacting the first wire of the lower twisted cable pair, and upper pressure contact portions between the upper surface of the holder and the first beam for contacting the first wire of the upper twisted cable pair, the second insulation displacement terminal fitting having lower pressure contact portions between the lower surface of the holder and the second beam for contacting the second wire of the lower twisted cable pair and upper pressure contact portions between the upper surface of the holder and the second beam for contacting the second wire of the upper twisted cable pair, first and second wire holding portions formed integrally with the respective first and second insulation displacement terminal fittings at positions external of the holder at the opposite longitudinal ends of the holder and configured to collectively hold all of the wires of the upper and lower twisted pair cables.

13. The electrical connector of claim 12, wherein the dividing rib has a tapered wedge-shaped upper guide projecting out beyond the upper surface of the holder and a tapered wedge-shaped lower guide projecting out beyond the lower surface of the holder.

* * * * *